US005107881A

United States Patent [19]

Feldman et al.

[11] Patent Number: 5,107,881

[45] Date of Patent: Apr. 28, 1992

[54] TENT CONSTRUCTION

[75] Inventors: Kenneth M. Feldman; John Tsatsos, both of Willowdale, Canada

[73] Assignee: Camp Mate Limited, Toronto, Canada

[21] Appl. No.: 442,270

[22] Filed: Nov. 28, 1989

[30] Foreign Application Priority Data

Feb. 20, 1989 [CA] Canada ..... 591565

[51] Int. Cl.[5] ..... E04H 15/36

[52] U.S. Cl. ..... 135/102; 135/105

[58] Field of Search ..... 135/102, 104, 117, 97, 135/91, 105

[56] References Cited

U.S. PATENT DOCUMENTS

| | | | |
|---|---|---|---|
| 2,893,411 | 7/1959 | Birch | 135/117 X |
| 3,052,250 | 9/1962 | Moss | 135/117 X |
| 3,055,379 | 9/1962 | Fink | 135/115 X |
| 3,182,672 | 5/1965 | Biller, Jr. | 135/117 |
| 3,536,083 | 10/1970 | Reynolds | 135/102 X |
| 3,670,747 | 6/1972 | Pohl et al. | 135/105 X |
| 4,067,347 | 1/1978 | Lipinski | 135/91 X |
| 4,102,352 | 7/1978 | Kirkham | 135/97 |
| 4,269,210 | 5/1981 | Marks | 135/104 |
| 4,709,718 | 12/1987 | Nichols | 135/115 X |

FOREIGN PATENT DOCUMENTS

| | | | |
|---|---|---|---|
| 1076339 | 2/1960 | Fed. Rep. of Germany | 135/102 |
| 1434721 | 10/1968 | Fed. Rep. of Germany | 135/105 |
| 1121850 | 8/1956 | France | 135/117 |
| 1318741 | 1/1963 | France | 135/117 |
| 341137 | 1/1931 | United Kingdom | 135/115 |
| 2121850 | 1/1984 | United Kingdom | 135/115 |

*Primary Examiner*—David A. Scherbel
*Assistant Examiner*—Lan Mai
*Attorney, Agent, or Firm*—Kenneth M. Garrett

[57] ABSTRACT

A ridge tent is provided with a permanent double roof, and may be erected without guying.

7 Claims, 2 Drawing Sheets

TENT CONSTRUCTION

FIELD OF INVENTION

This invention relates to tents. It particularly relates to ridge tents supported from an exterior framework.

BACKGROUND OF INVENTION

In a tent of the foregoing nature, the tent is suspended from a first sleeve which connects to the roof along the ridge line, and to second sleeves, which are normally sewn into the joint of the roof and lateral side walls at eave seams. Such seams are a perennial source of leakage, and since the supporting sleeves trap rainwater in this area, the problem is exacerbated. The roof is normally coated on the interior thereof with an impervious material, whereby it cannot breath, and at colder temperatures condensation on the roof is experienced. On hotter days, excessive temperatures within the tent are experienced.

It is common to use a separate fly cover over a tent. This tends to reduce certain of the above inconveniences, but it normally requires to be separately set and guyed.

It has been proposed prior hereto to secure the fly cover to the roof of a tent along the ridge sleeve. In accordance with such proposal, the fly is not connected to the tent along the eaves. Such tent is supported from the eave poles by tapes sewn into the eave seam, and which are tied about the eave poles when the tent is erected; this fly also requires to be separately guyed.

It is an object of this invention to provide an easily erected frame tent which is less susceptible to leakage at the seams.

It is a further object of this invention to provide a double roof tent that is capable of being rapidly erected, without the use of guys.

SUMMARY OF INVENTION

In accordance with one aspect of the invention, a tent of the type supported from a framework including a central ridge pole and an eave pole at each lateral side thereof has an outer roof attached to the framework for support thereby to define a ridge line and outer tent eaves. Such tent further includes an inner roof, and a side wall securing to the inner roof at each lateral side thereof to define an inner eave seam. Web means connects each inner eave seam to the outer roof along an adjacent outer tent eave, and along the ridge line. Additionally, the inner roof has a length taken in any transverse plane less than that of the outer roof.

Accordingly, in such improved tent, the inner roof and tent side walls will be automatically suspended beneath the outer roof upon erection of the outer roof upon the framework, and the inner eave seams will be overhung by the outer eaves of the tent and protected thereby.

Preferably, the eave poles are supported from the ground surface upon which the tent is erected by support poles at each end thereof that are downwardly inwardly convergent. Accordingly, the outer roof and inner roof may be held in position by exerting a tension through the side walls of the tent, without necessitating guying or the use of spacer poles between the ridge pole and eave poles, as required by the prior art proposal.

Desirably, the eave poles are curvilinear, being arched upwardly across each lateral side of the tent. This has the effect of tensioning the inner and outer roofs in both transverse and lateral directions through application of a tensioning force through the side walls of the tent, thereby reducing fluttering of the roofs. It also has the effect of arching the roof whereby rain water is directed away from the eaves, towards the front and back of the tent.

Since the tent has a permanently structured double roof, the interior roof can safely be made of a breathable fabric, and may also be provided with closable openings to permit air circulation.

The outer roof may be provided with extensions to the gables and outer eaves as desired, which may act to form a double wall structure or provide a partially covered space around the tent, including a canopy therefor, for example.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
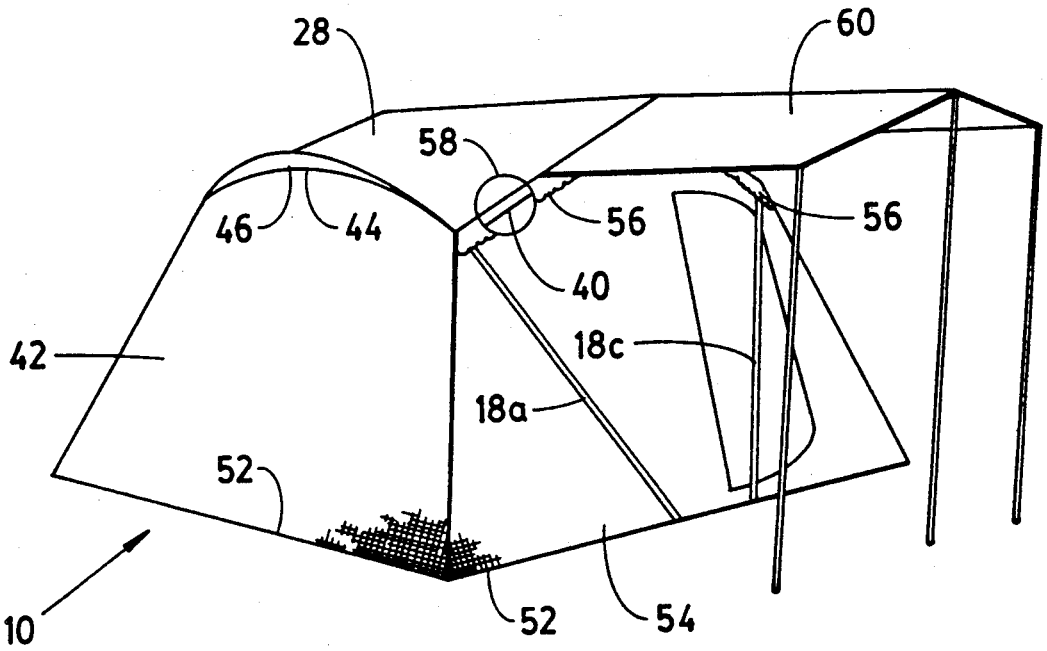
FIG. 1 shows a tent in accordance with the invention in perspective view, from the front, right side, with a small, circular portion highlighted to reveal hidden structure.

In the drawings, like parts are identified throughout by like numbers. Considering the drawings in detail, a tent is identified generally therein by the numeral 10. Tent 10 comprises a framework comprising a central, horizontal ridge pole 12 supported from a ground surface by uprights 14, and by upwardly arched eave poles 16 on each lateral side thereof supported by identical posts 18*a*,18*b* at one side and 18*c*, 18*d* at the other side, which may be collectively referred to as posts 18, which posts are downwardly inwardly inclined. Eave poles 16 will reside in the plane containing support posts 18 associated therewith. Tent 10 has a rectangular vertical plan-form, identified by dashed line 26, the corners of which are vertically below the four points of interconnection between posts 18*a*, 18*b*, 18*c*, 18*d* and eave poles 16.

Figure 3:
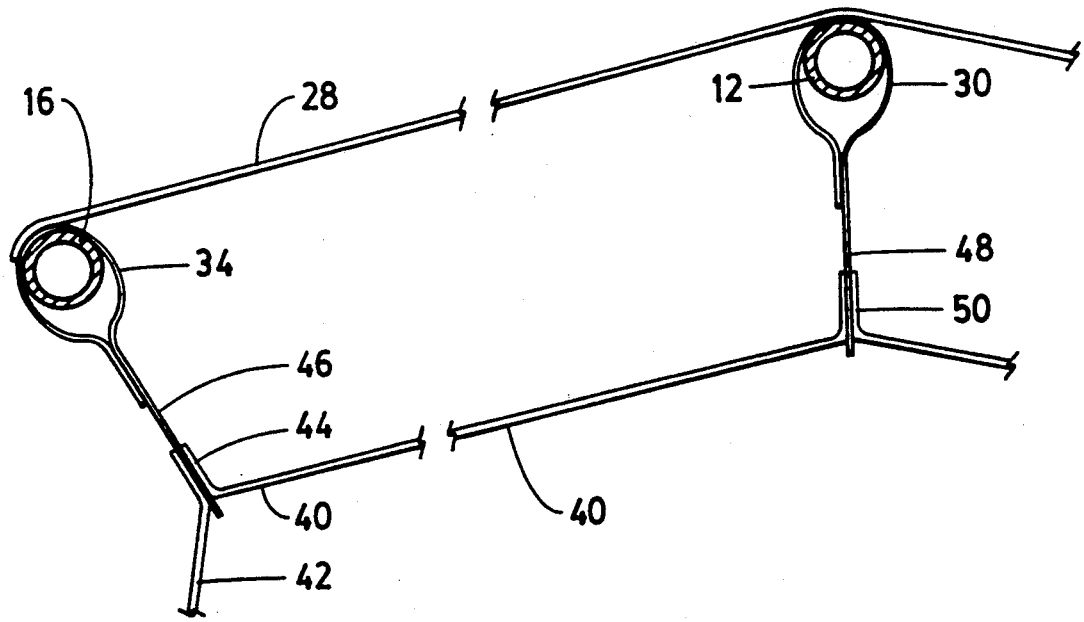
FIG. 3 shows an enlarged medial section of the tent roof of FIG. 1 through the ridge pole and one eave pole, broken to show indefinite length.
Figure 2:
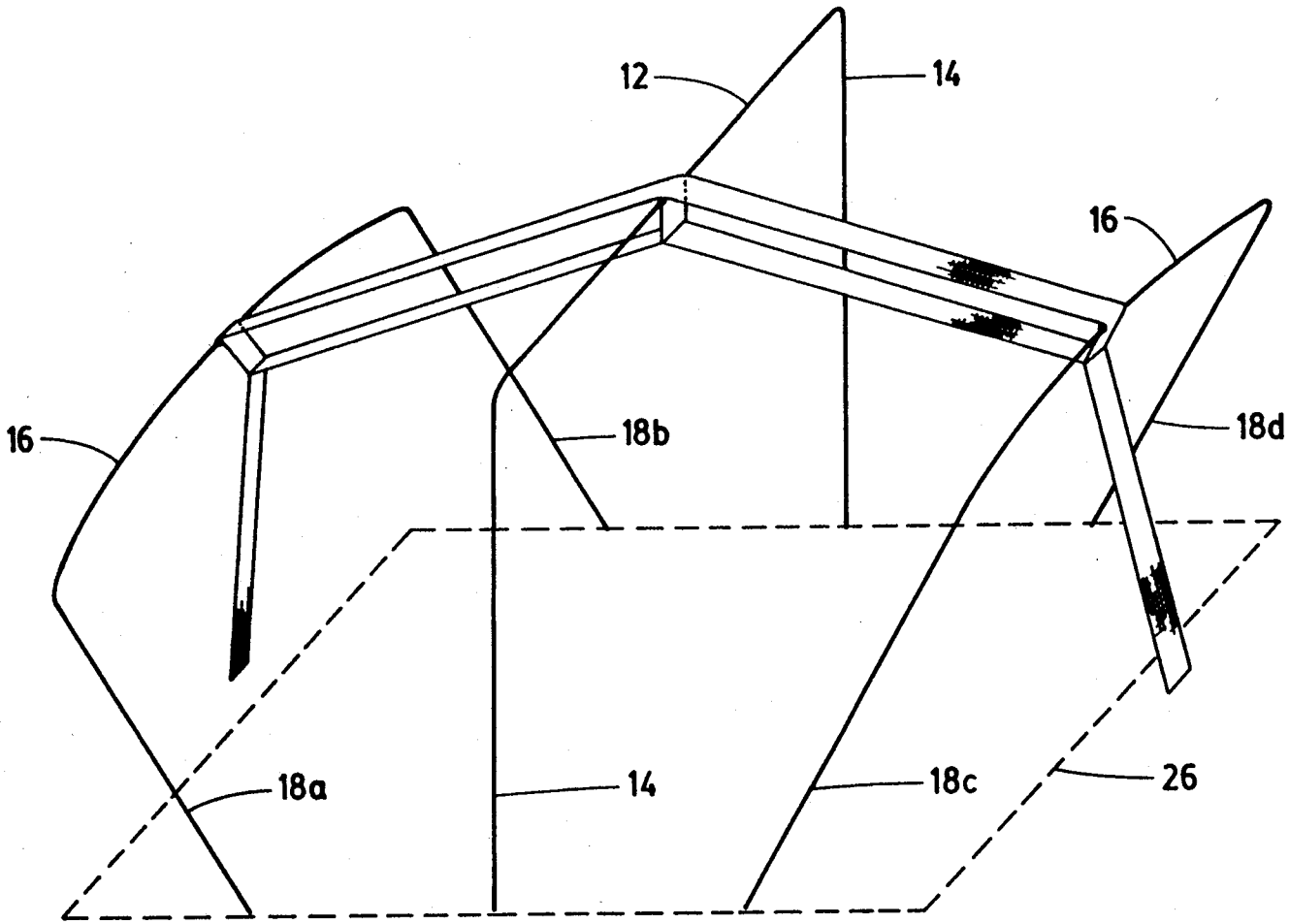
FIG. 2 located on the second sheet of drawings, shows the framework of the tent of FIG. 1 with a small medial strip of roof and wall fabric in perspective, schematic form, as seen in perspective from the front left side.

Considering particularly FIG. 2 wherein a narrow medial portion of tent fabric only is shown, and FIG. 3, which reveals the construction in greater detail, tent 10 comprises an outer roof 28, to which there is sewn along the ridge line a sleeve 30 and along the lateral margins of the outer roof, a sleeve 34 to define an outer eave, through which sleeves the ridge and eave poles 12 and 16 respectively, are readily passed as a first step in erecting tent 10. Tent 10 further comprises an inner roof 40, to which there is sewn along each lateral margin a side wall 42 at seam 44 to define an inner eave. A web 46 connects each inner eave seam 44 to a sleeve 34. Similarly, the ridge of second roof 40 is attached to ridge sleeve 30 by a web 48 at ridge seam 50. Preferably webs 46 and 48 are continuous, although it may be found desirable to provide one or more small discontinuities particularly in web 46 to assist in threading arcuately formed eave poles 16 through sleeve 34.

Tent 10 is erected in accordance with one sequence by first engaging the ridge pole 12 and eave poles 16 in their respective sleeves 30,34, then supporting the poles on their respective supports (uprights 14 and posts 18). Following this the lower margin of 52 of tent 10 is staked to the ground surface by tent pegs or the like (not shown) to create a downward tensioning force in the side walls 42, front wall 54 and a similar back wall (not seen in the drawings). Such tensioning forces will be transmitted to outer and inner roofs 28, 40 to create both transverse and lateral tensioning forces therein, whereby tent 10 may be supported without requiring guys. Other sequences of erection of tent 10 are also possible, but in accordance with these both outer and inner roofs 28,40 may be adequately tensioned without necessitating guying.

As will be appreciated from FIGS. 2 and 3, the transverse dimension of outer roof 28 in any transverse plane is greater than that of inner roof 40, whereby the outer eaves at sleeve 34 of tent 10 overhang the inner eaves, at seam 44, thereby protecting the seam 44 to reduce the incidence of leakage therethrough. The double roof structure of tent 10 also provides greater insulation for the tent, and the insulative power may be increased by providing outer roof 28 with a fringe like flap 56 along the gable edge 58 thereof. Additionally, a canopy 60 may be formed as an integral extension to outer roof 28.

It will be apparent that many changes may be made to the illustrative embodiment while falling within the scope of what has been invented, and it is intended that all such changes be covered by the substance of the claims appended hereto.

We claim:

1. A tent comprising a supporting framework including a central ridge pole and an eave pole at each lateral side thereof;

an outer roof attached to said framework for support thereby to define tent eaves and a ridge line;

an inner roof;

a side wall connected to said inner roof at each lateral side thereof at eave seams, and a first web means connecting between said inner roof and said outer roof along said ridge line; a second web means connecting between said eave seams and said tent eaves, whereby said inner roof and said side walls are suspended beneath said outer roof;

at least said second web means extending continuously along said eave seams;

said inner roof having a length taken in any transverse plane less than that of said outer roof whereby said eave seams are overhung by said tent eaves.

2. A tent as defined in claim 1, wherein said eave poles are upwardly arcuately formed.

3. A tent as defined in claim 2, wherein said eave poles are supported from ground bearing posts that are downwardly inwardly inclined.

4. A tent as defined in claim 1, wherein said outer roof has a fringe like flap on edges thereof extending between said ridge line and said eaves.

5. A tent as defined in claim 1, wherein said outer roof is secured to said ridge pole and said eave poles by sleeves secured to the underside of said outer roof.

6. A tent as defined in claim 5, wherein each of said first and second web means forms a part of said sleeves.

7. A tent as defined in claim 6, wherein said first web means is substantially continuous along said ridge line.

* * * * *

UNITED STATES PATENT AND TRADEMARK OFFICE

CERTIFICATE OF CORRECTION

PATENT NO. : 5,107,881

DATED : April 28, 1992

INVENTOR(S) : Benjamin L. Feldman, et al

It is certified that error appears in the above-identified patent and that said Letters Patent is hereby corrected as shown below:

On the title page, item (75):

First inventor's name should read --Benjamin L. Feldman--

Signed and Sealed this

Seventeenth Day of August, 1993

*Attest:*

*Attesting Officer*

BRUCE LEHMAN

*Commissioner of Patents and Trademarks*